US005788160A

United States Patent [19]

Woog

[11] Patent Number: 5,788,160

[45] Date of Patent: Aug. 4, 1998

[54] STEAM ATOMIZER ATTACHMENT FOR SHOWER

[76] Inventor: Gunter Woog, 5435 Bauers Dr., West Bend, Wis. 53095

[21] Appl. No.: 682,121

[22] Filed: Jul. 17, 1996

[51] Int. Cl.[6] ..... B05B 15/06

[52] U.S. Cl. ..... 239/282; 239/446; 239/553.3; 4/605

[58] Field of Search ..... 239/280, 282, 239/280.5, 283, 443, 444, 446, 553, 553.3, 575, 590, 590.3; 4/597, 605

[56] References Cited

U.S. PATENT DOCUMENTS

| | | | |
|---|---|---|---|
| Re. 15,766 | 2/1924 | Hardie | 239/553.3 |
| 871,003 | 11/1907 | Teall | 239/575 |
| 1,652,437 | 12/1927 | Handelan | 4/605 |
| 2,621,078 | 12/1952 | Wahlin | 239/154 |
| 2,973,905 | 3/1961 | Ackley | 239/575 |
| 3,037,710 | 6/1962 | Kusznier | 239/575 |
| 3,375,532 | 4/1968 | Gellmann | 4/145 |
| 3,713,589 | 1/1973 | McNair et al. | 239/575 |
| 3,936,891 | 2/1976 | Kulde | 4/145 |
| 4,084,271 | 4/1978 | Ginsberg | 4/161 |
| 4,303,201 | 12/1981 | Elkins et al. | 239/383 |
| 4,625,917 | 12/1986 | Torney | 239/444 |
| 4,752,975 | 6/1988 | Yates | 4/601 |
| 4,997,007 | 3/1991 | Niemann et al. | 137/625.47 |
| 5,065,942 | 11/1991 | Shannon | 239/282 |
| 5,142,713 | 9/1992 | Makool | 4/525 |
| 5,425,394 | 6/1995 | Clare | 137/270 |
| 5,441,075 | 8/1995 | Clare | 137/454.6 |
| 5,551,637 | 9/1996 | Lo | 239/394 |

*Primary Examiner*—Andres Kashnikow
*Assistant Examiner*—Lisa Ann Douglas
*Attorney, Agent, or Firm*—Ryan, Maki, Mann & Hohenfeldt

[57] ABSTRACT

An adaptor for a shower includes a valve component having a threaded end for connection to a shower pipe and a first nipple for connection to a showerhead. A second nipple is provided for attachment thereto of a sauna-simulating steam/hot water mist. A diverter valve controls the flow alternatively between the showerhead and the steam spray attachment. The steam spray attachment includes a screen having openings of approximately 25 to 75 microns for breaking down a stream of flowing water into a steam-like mist of fine droplets and water vapor. The broken down stream of water is then sprayed through a nozzle opening, preferably providing a fan-shaped spray. The nozzle opening is of the size to accommodate a flow of about 0.2 to 0.4 gallons per minute.

5 Claims, 3 Drawing Sheets

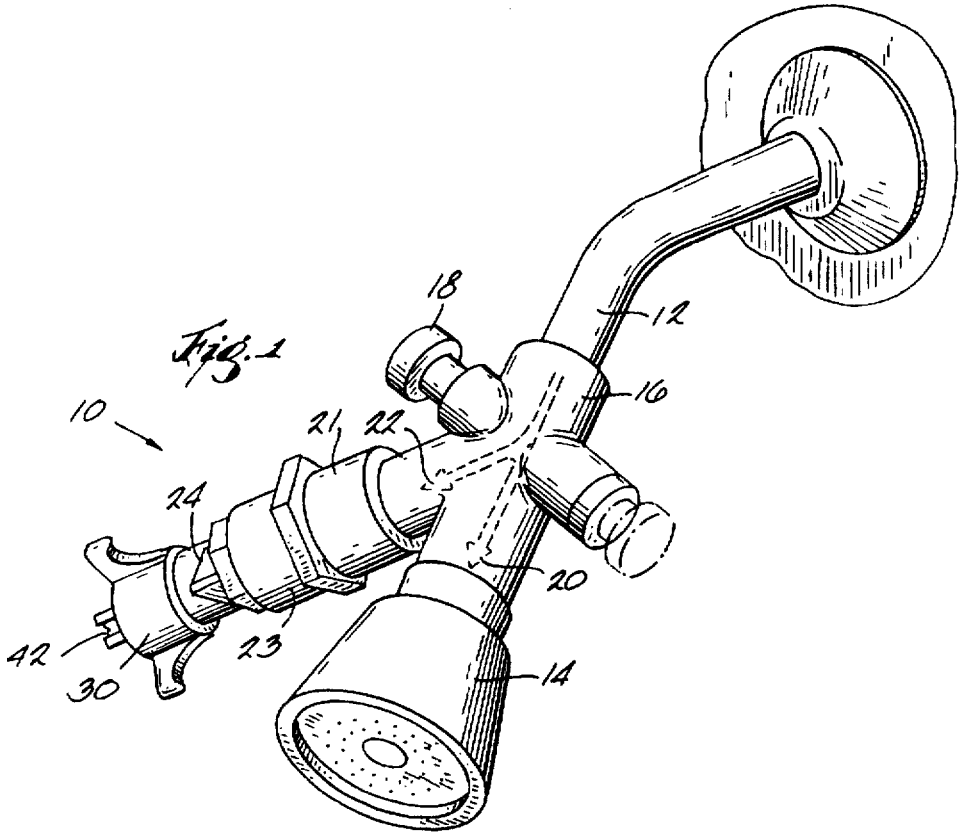
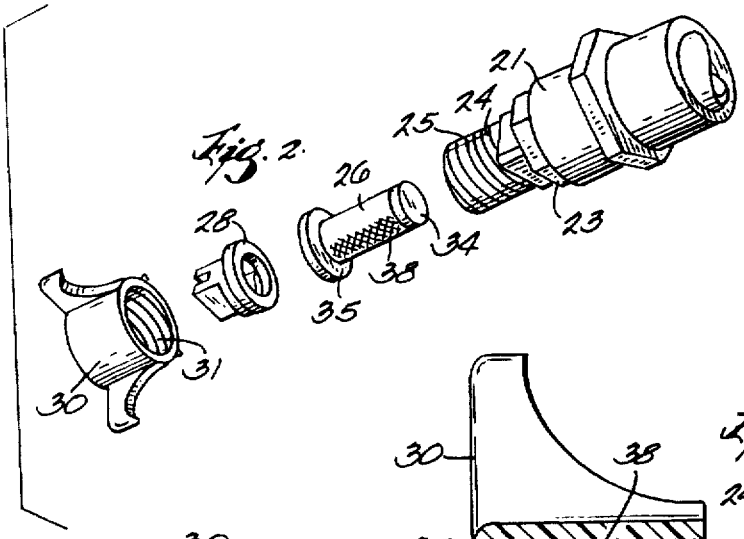
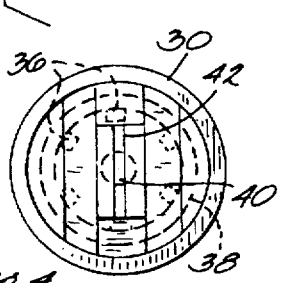
Fig. 4
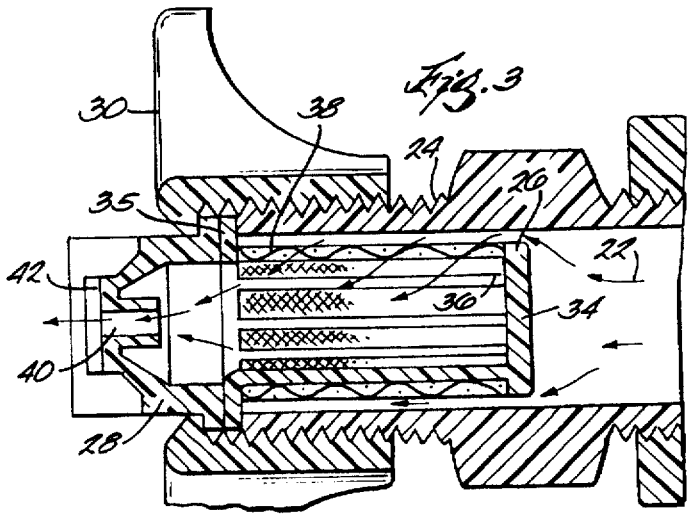

STEAM ATOMIZER ATTACHMENT FOR SHOWER

FIELD OF THE INVENTION

This invention relates to shower attachments. More particularly the invention relates to an attachment to a standard shower nozzle which permits switching of the same between operation as a conventional shower and operation as a sauna-simulating steam shower.

BACKGROUND OF THE INVENTION

Various proposals have heretofore been devised for attachment to shower nozzles in order to break the spray into a finely divided steam like mist. See, for example, U.S. Pat. No. 5,142,713 wherein a spray of water was first broken up within a nozzle structure and then sprayed on a wall surface which was provided with projections to cause further splashing and spraying of the water droplets.

In another example of such a device, see U.S. Pat. No. 4,084,271

The foregoing devices have met with limited commercial success and acceptance and a need has thus continued to exist for a shower converter device wherein the water can readily be diverted between a showerhead and, alternatively, to a fine spray/steam producing mode.

SUMMARY OF THE INVENTION

It is a principal object of the invention to provide a shower adaptor system including a diverter valve which enables easy switching of the flow of a stream of hot water from a showerhead to a steam and mist producing attachment.

In accordance with one aspect of the invention a stream of hot water is broken up by a device of the present invention into a finely divided mist of water and steam. In accordance with an important aspect of the invention the device utilizes very simple and inexpensive components to accomplish these purposes. Hence the benefits of a sauna simulating steam spray are achieved utilizing simple components which enhance the cost effectiveness of the device.

In accordance with further related aspects of the invention the apparatus includes a device which utilizes a fine screen having openings in the range of approximately 50 microns to break up a stream of hot water into a steam-like spray of fine droplets, mist and hot water vapor. In conjunction with such a screen the broken-up stream of hot water is discharge through a spray nozzle having a small opening, preferably a fan spray nozzle.

Further, objects and advantages of the invention will become apparent from the following detailed description and accompanying drawings.

BRIEF DESCRIPTION OF THE DRAWINGS

FIG. 1 is a perspective view of one embodiment of a shower attachment of the present invention shown in conjunction with a conventional showerhead and water discharge conduit;

FIG. 2 is a perspective view of the effective components of the attachment of FIG. 1 with the parts shown disassembled and in relation to each other for clarity;

FIG. 3 is a sectional view of the distal portion of the attachment of this invention showing the flow of water therethrough;

FIG. 4 is an end view of the nozzle of FIG. 3 with internal parts shown by phantom lines;

DETAILED DESCRIPTION OF THE PREFERRED EMBODIMENTS

Figure 5:
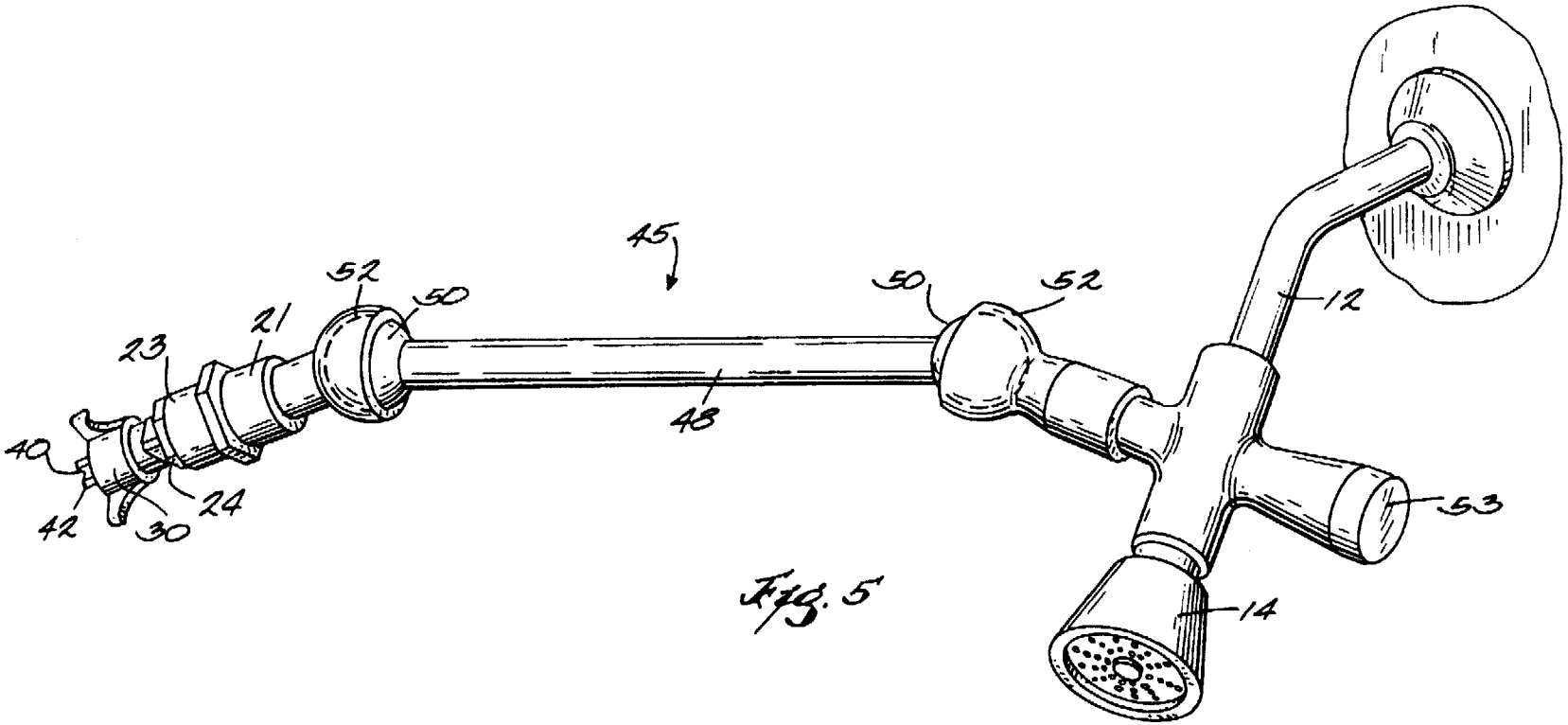
FIG. 5 is a perspective view showing an alternative embodiment of an attachment in accordance with the invention assembled together with a water discharge pipe and a conventional showerhead; and, FIG. 6 is a perspective view showing yet another alternative embodiment of an attachment in accordance with the invention assembled together with a water discharge pipe and a conventional showerhead.

Referring more particularly to the drawings there is seen a device 10 in the form of an attachment installable on a water discharge pipe 12 of a conventional shower bath. Attachment 10 is also adapted to receive, on one part thereof, a standard showerhead 14 with an angular portion 16 of attachment 10 fitting between the discharge pipe 12 and the showerhead 14 as best seen in FIG. 1.

A diverter valve 18 is adapted to switch the flow of water from pipe 12 to a stream 20 which passes through showerhead 14 or optionally to a stream 22 which discharges through aperture 40 the nozzle in 28 at the discharge end of attachment 10. In the illustrated embodiment a coupling, for example, one-half inch which will threadably fit a standard discharge pipe 12 is used to connect the body of attachment 10 to a reducer 23 into which a smaller diameter nozzle body 24 can be threaded. In the illustrated embodiment nozzle body 24 is a annular tubular body having preferably ¼ inch outer diameter which is provided with threads 25.

A flanged nozzle strainer 26 is adapted to fit within the interior of nozzle body 24 and to be held in place therein by a nozzle 28 which is coupled to nozzle body 24 by means of a threaded nozzle cap 30 having interior threads 31 which are threadably received on threads 25.

As further seen in FIGS. 2 and 3, nozzle strainer body 26 is closed at its proximal end 34, which is preferably molded integrally with longitudinal ribs 36. Ribs 36 are spaced around the circumference of nozzle strainer body 26. Ribs 36 are fitted within the strainer screen 38 and support the screen in an annular position, preventing it from being compressed during use. Flange 35 fits between the discharge nozzle 28 and the distal end of nozzle body 24. The outer diameter of flanged nozzle body 26 is sufficiently smaller than the interior diameter of strainer nozzle body 24 to allow a stream 22 of water to flow therebetween as seen in FIG. 3. Thus stream of hot water 22 is forced to flow between the interior of nozzle body 24 and then inwardly through screen 38. Screen 38 preferably has openings in the range of 25 to 75 microns and preferably about 50 microns and causes a breakup of the stream of hot water 22 into very fine droplets which are immediately expelled through a spray aperture 40 provided through spray nozzle 28. Screen 38 also performs a protective function in preventing dripping from aperture 40, thus protecting a user from being scalded by hot water droplets.

Preferably the tip of nozzle 28 has a slotted opening 42 which causes discharge of the spray in the form of a flattened or fan spray. Nozzle aperture 40 is preferably in the size range to provide a flow of about 0.2 to 0.4 gallons per minute under typical household water pressure conditions.

An alternative of embodiment 45 of a spray attachment to the device of this invention is illustrated in FIG. 5. Attachment 45 is also adapted to be threaded to a conventional shower discharge pipe 12 and to couple the same to a showerhead 14.

In order to provide further adjustability an adjustable arm 48 having swivel fittings at each end is utilized. In the illustrated embodiment the swivel fittings are provided by utilizing a ball 50 at each end of arm 48, which balls are pivotally fitted within sockets 52 at each end, thus adjustably connecting the discharge nozzle 40 to the shower discharge pipe 12. A suitable diverter valve 53 is provided to adjustably direct the flow either to nozzle 14 or to steam discharge nozzle 28.

Figure 6:
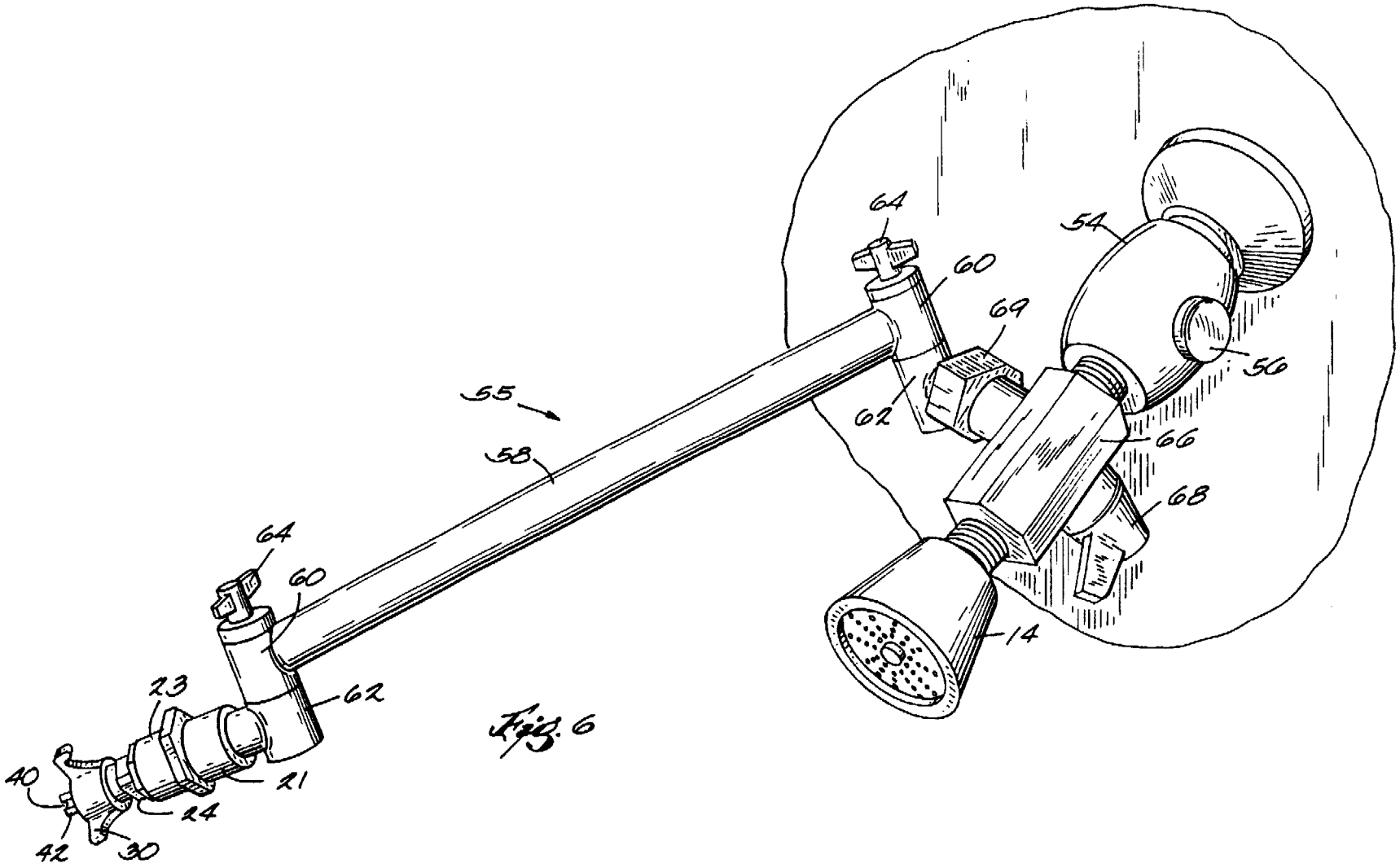

Another alternative of embodiment 55 of a spray attachment to the device of this invention is illustrated in FIG. 6. Attachment 55 is also adapted to be threaded to a shower discharge outlet 54, which is fitted with a push button operable adjustable flow restricter device 56.

In order to provide adjustability, an adjustable arm 58 having pivoting fittings 60 at each end is utilized. In the illustrated embodiment the pivoting fittings are adjustably connected at each end to mating fitting components 62, which are angularly adjusted and fixed in place by clamping thumb screws 64, thus adjustably connecting the discharge nozzle 40 to the shower discharge outlet 54. A diverter valve body 66 is provided with a nipple, as shown to couple the same to a showerhead 14. To adjustably direct the flow either to nozzle 14 or to steam discharge nozzle 40, a diverter valve stem, manually rotatable by means of a lever 68 is provided.

Thus, various embodiments of the invention having desired degrees of adjustability for placement of nozzle 40 in a desired location within a shower stall are provided.

While preferred embodiments of the invention have been shown for purposed of illustration it will be appreciated that the those skilled in the art may modify the device within the spirit of the invention only as limited by the appended claims and reasonable equivalents thereof.

What is claimed is:

1. An attachment for a shower to produce a steam-like, sauna simulating spray, comprising, a connector body adapted to be threadably attached to a water discharge pipe for a shower, said connector body including a pair of discharge nipples including a first nipple for adapted for attachment thereto of a showerhead, a second nipple adapted for attachment thereto of an attachment for breaking a flow of hot water into a steam-like mist, a diverter valve adapted for alternatively diverting a flow of water from said shower discharge pipe into a showerhead or attached thereto or into said attachment, said attachment including an annular nozzle body, a screen having openings approximately 25 to 75 microns in diameter impeding the flow of water through said nozzle body and causing a stream of water flowing through said nozzle body to be broken into a water vapor mist, said screen being in the form of an annular plug having a closed first end and an open second end for discharge of droplets of water vapor gassing through said screen, and means within said screen to support said screen in an annular shape, and a spray nozzle connected to the discharge end of said nozzle body for discharge of a spray of said water vapor.

2. A device according to claim 1 wherein said screen second end includes a flange for supporting said screen and for blocking the flow of water through said second end except through said opening.

3. A device according to claim 2 wherein a plurality of longitudinal axial ribs are attached to said flange and extend longitudinally within said screen to support said screen in an annular shape.

4. An attachment according to claim 1 wherein said nozzle includes a central opening and a distal surface having a single slot traversing said opening whereby said nozzle is adapted to provide a fan shaped spray of water vapor.

5. An attachment for a shower to produce a steam-like, sauna simulating spray, comprising, a connector component having a threaded end for connection to a shower pipe, a first nipple for connection to a showerhead and a second nipple for attachment of a sauna-simulating steam/hot water mist component, said connector component including a diverter valve which controls the flow alternatively between said first nipple and said second nipple, said steam spray attachment including an annularly shape screen having openings of approximately 25 to 75 microns for breaking down a stream of flowing water into a steam-like mist of finely divided droplets and water vapor, means within said screen to support siad screen in an annular shape, and a nozzle having a discharge opening of a size to accommodate a flow of about 0.2 to 0.4 gallons per minute, said nozzle being provided with a slot on its surface spanning said discharge opening whereby a fan-shaped discharge is produced.

* * * * *

UNITED STATES PATENT AND TRADEMARK OFFICE

CERTIFICATE OF CORRECTION

PATENT NO. : 5,788,160

DATED : Aug. 4, 1998

INVENTOR(S) : Gunter Woog

It is certified that error appears in the above-identified patent and that said Letters Patent is hereby corrected as shown below:

| | |
|---|---|
| Column 3, Line 39 | Delete "for" first occurrence |
| Column 3, Line 46 | Delete "or" first occurrence |
| Column 4, Line 8 | Delete "and" first occurrence |
| Column 4, Line 40 | Delete "siad" and substitute --- said --- |

Signed and Sealed this

Thirtieth Day of May, 2000

*Attest:*

Q. TODD DICKINSON

*Attesting Officer*

*Director of Patents and Trademarks*